United States Patent [19]

Esche

[11] 4,059,144

[45] Nov. 22, 1977

[54] APPARATUS FOR FORMING SHELL MOLDS

[76] Inventor: Delbert Eugene Esche, 34446 Marquette, Westland, Mich. 48185

[21] Appl. No.: 726,176

[22] Filed: Sept. 24, 1976

[51] Int. Cl.[2] ..... B22D 11/08

[52] U.S. Cl. ..... 164/166

[58] Field of Search ..... 164/166, 165, 21, 43

[56] References Cited

U.S. PATENT DOCUMENTS

| | | | |
|---|---|---|---|
| 2,762,092 | 9/1956 | Klamp et al. | 164/166 |
| 2,820,997 | 1/1958 | John | 164/166 |

FOREIGN PATENT DOCUMENTS

| | | | |
|---|---|---|---|
| 1,097,027 | 2/1955 | France | 164/21 |
| 737,143 | 9/1955 | United Kingdom | 164/21 |

OTHER PUBLICATIONS

*Metal Industry,* Jan. 1, 1954, p. 6, "Shell Moulding Plant".

*Primary Examiner*—Ronald J. Shore
*Attorney, Agent, or Firm*—Krass & Young

[57] ABSTRACT

Apparatus for forming molded shapes such as shell molds is disclosed which features a transport mechanism advancing a pattern carrier assembly progressively through a mold mix dispensing station, an excess mix discharging station, through an oven where the mold is cured, and thence to a mold unloading station. The pattern carrier assembly is then retracted back through the curing oven where the pattern or patterns are preheated prior to retraction to the initial mix dispensing station, to be in position for initiation of another cycle. The transport mechanism includes a power cylinder reciprocating a yoke assembly by means of a connected operator rod. The pattern carrier plate is rotatably supported on the yoke assembly so that a rack and pinion means interacting with the pattern plate will produce a mix discharging rotation of the pattern carrier plate after exiting from the mix dispensing station. The mold curing and pattern heating oven includes a bottom hinged slotted closure at both the entrance and exit thereof opened by advance and retraction of the pattern carrier assembly into engagement therewith which allows for closure of the oven during curing and heating operations without the need for complicated control devices. Also disclosed is the provision of ejection pins carried by the pattern carrier assembly which automatically eject the cured shell molds at the unloading station. The pattern carrier plate is disclosed as having a capacity for either a single or a multiple number of patterns.

21 Claims, 7 Drawing Figures

Fig-6
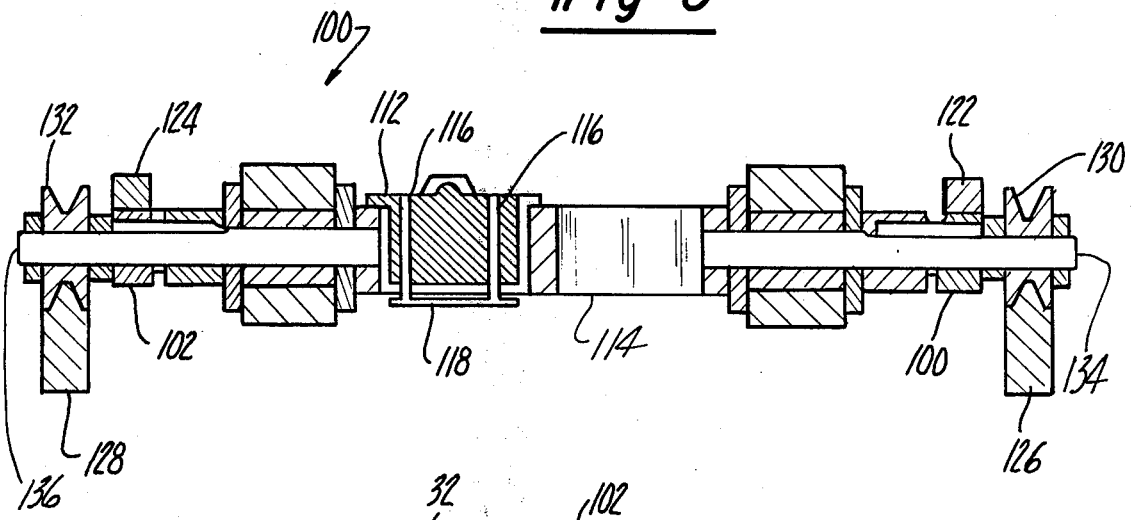
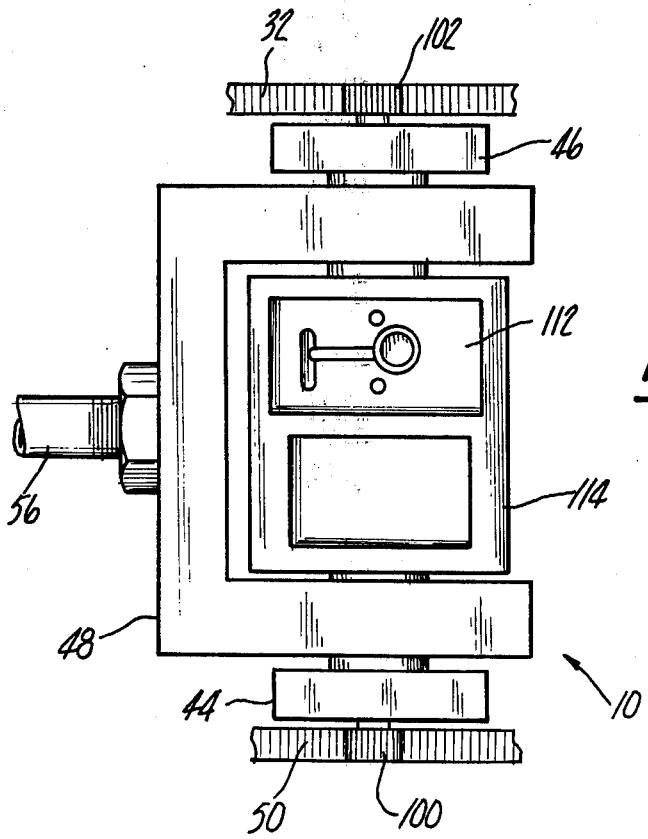
Fig-7

APPARATUS FOR FORMING SHELL MOLDS

BACKGROUND OF THE INVENTION

1. Field of the Invention

This invention concerns fabrication of molded shapes and more particularly apparatus for manufacturing shell molds which is adapted to automated manufacturing operations.

2. Description of the Prior Art

The shell mold process for the production of foundry molds is widely utilized in industry since it has many marked advantages over the older green sand molding process, such as the ease of obtaining close tolerance castings with excellent surface finish, good and consistent pattern reproduction, the quantity of sand is reduced, the molds may be stored indefinitely, etc. The fabrication of the shell mold basically involves the use of a molding mix comprised of a dry mixture of sand and a thermosetting resin, the thermosetting resins either mixed thereinto as a separate granulation from the dry sand or, as more recently practiced, the sand grains themselves may be coated with the resin to insure uniformity of dispersion of the resin and sand. The process includes the step of preheating a mold pattern prior to dispensing a quantity of the mixture onto the pattern, where it is allowed to remain for a short interval. The excess which does not adhere to the pattern is then discharged, and the mold pattern is placed in a curing oven to thoroughly cure the resin binder and form a relatively thin but strong mold which is then removed from the pattern ready for use.

The relative simplicity of the shell molding process lends itself to being automated and many such arrangements are known in the prior art. However, these approaches usually involve relatively complicated rotary transfer or conveyor means for transporting the pattern through the various stations where the necessary operations for carrying out the fabrication of the shell mold are performed, with relatively complicated controls required to synchronize the various operations with the transport of the pattern.

Furthermore, numerous solenoid or fluid pressure actuators for carrying out the various operations are required, which actuators in some designs are subjected to heating in the curing or pattern preheating ovens. These factors lead to considerable maintenance requirements for the machinery involved and also to a none-too-reliable performance.

In addition, the conventional practice in which separate ovens for preheating the pattern and for curing the mold is relatively wasteful of energy, and if both heating functions could be carried out by a single oven, a more energy efficient process would result.

In connection with this latter point, oven closures have commonly been dispensed with since the required automatic controls would further increase the complexity and accordingly the maintenance requirements of the apparatus, further exacerbating the energy wastefulness of the equipment.

It is therefore an object of the present invention to provide a process and apparatus for production of molded shapes such as shell molds adapted to automated manufacture thereof by means of a simplified transport mechanism and associated controls.

It is a further objection of the present invention to provide such an arrangement in which the number of actuator devices is greatly reduced.

It is yet another object of the present invention to provide such a system in which a single oven can provide both the pattern heating and mold curing functions.

SUMMARY OF THE INVENTION

These and other objects which will become apparent upon a reading of the following specification and claims is accomplished by an arrangement wherein a pattern carrier assembly is transported by a linear reciprocal movement from an initial position at a mix dispensing station through an excess mix discharging station and thence into a mold curing oven. Further advancing linear movement transports the pattern carrier assembly to a mold unloading station beyond the mold curing oven where the finished mold or molds are removed. The pattern or patterns are heated during the return stroke by a dwell period within the shell mold curing oven prior to being returned to the mix dispensing station preparatory to initiation of a new cycle. The mold pattern or patterns are supported in the pattern carrier assembly by means of a pattern plate rotatably mounted on a yoke, with a rack and pinion drive providing rotation of the pattern carrier plate upon advance of the yoke out of the mix dispensing station to discharge the excess mix from the pattern. The shell mold curing oven is provided with a bottom hinged closure at each of the entrance and exit of the oven which are adapted to swing inwardly and outwardly upon engagement with the pattern carrier assembly as it advances and retracts respectively through the shell mold curing oven, to provide closure of the oven during the mold curing and pattern heating cycles without the need for automatic controls.

BRIEF DESCRIPTION OF THE DRAWINGS

FIG. 6 is a sectional view of an alternate form of the pattern carrier assembly from that shown in FIGS. 3–5 which view also shows an alternate guide bar construction; and FIG. 7 is a plan view of a carrier assembly of an alternate construction from that shown in FIGS. 3–5.

DETAILED DESCRIPTION

Figure 1:
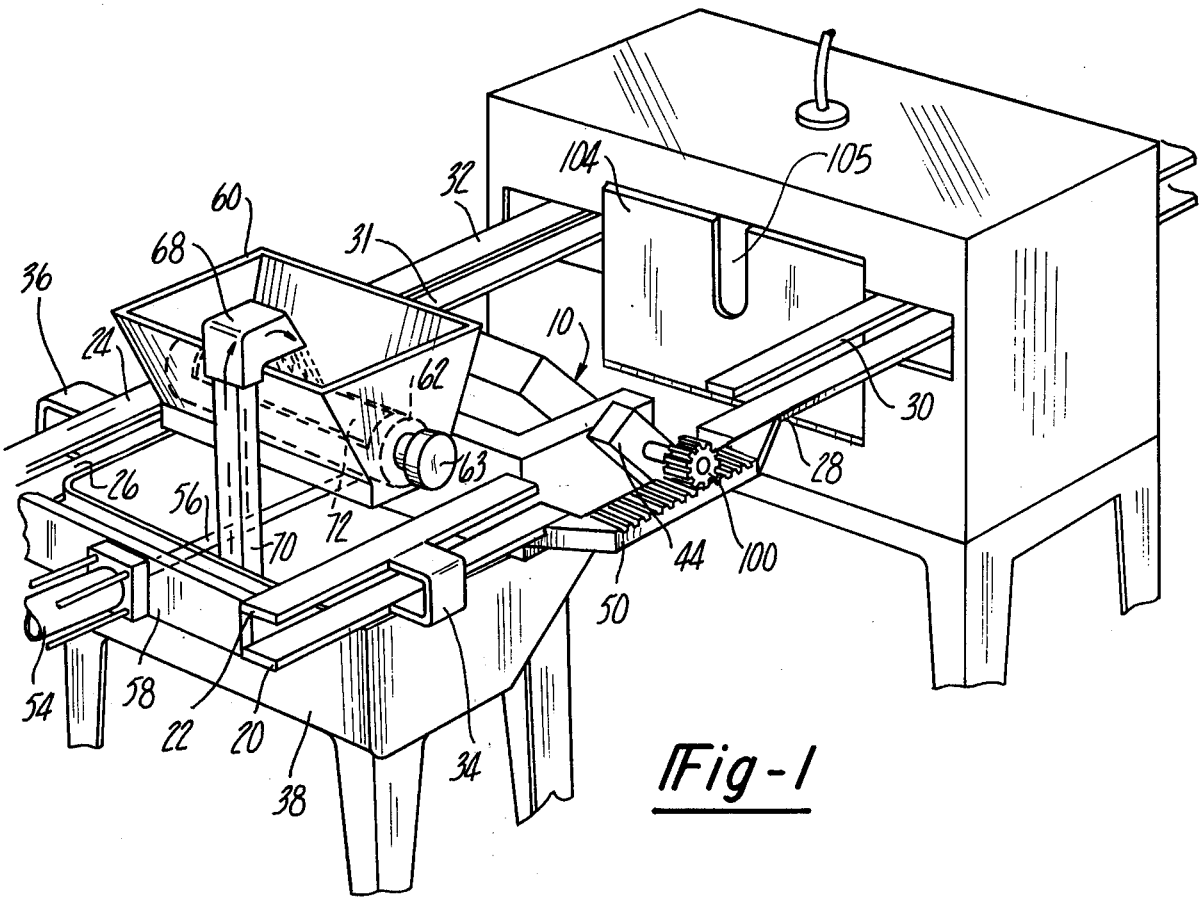
FIG. 1 is a perspective view of a portion of the apparatus constructed according to the present invention.

In the following specification, specific terminology will be utilized and particular embodiments described in accordance with the requirements of 35 USC 112 but it is to be understood that the terminology of the particular embodiments are not intended to limit the invention to the specific recitations inasmuch as the invention is susceptible of wide variations within the scope of the present invention.

The apparatus for forming shell molds according to the present invention includes a pattern carrier assembly 10 adapted to be linearly reciprocated from an initial position at a molding mix dispensing station 12 (FIG. 2) to a mix discharging station 14, through a mold curing and pattern heating oven 16, and finally to a mold unload station 18. After this advancing movement, the pattern carrier is retracted progressively through the shell mold curing and pattern heating oven 16 to the initial position at the mix dispensing station 12. While the pattern carrier assembly 10 is shown in phantom at these various points in its travel, it should be understood that only a single carrier assembly 10 is contemplated in the apparatus shown in FIGS. 1 and 2.

The linear transport means providing reciprocation of pattern carrier assembly 10 includes two pairs of guide track sections formed by guide bars 20 and 22 and 24 and 26 respectively extending through the region of the mix dispensing station 12 and guide track sections comprised by guide bars 28 and 30 and 31 and 32 extending through the shell mold curing and pattern heating oven 16 and the mold unload station 18.

In order to clearly depict the principle of the apparatus, certain of the structural details for support of various components are not shown in these drawings inasmuch as such details do not comprise the present invention.

For example, however, guide bar sets 22 and 20 may be supported by means of a bracket 34 while guide bars 24 and 26 are shown as supported by a bracket 36 both of which are secured to a bin 38. Guide bars 28 and 30 and 31 and 32 could be secured to the housing 40 of the shell mold curing and pattern heating oven 16 as well as the support structure 42 provided at the unload station 18.

Figure 3:
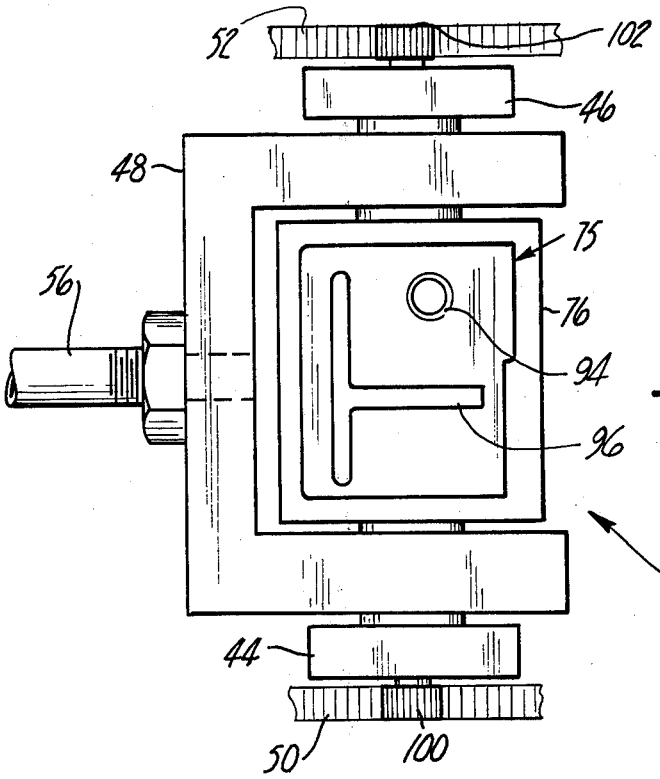
FIG. 3 is a plan view of the pattern carrier assembly incorporated in the apparatus depicted in FIGS. 1 and 2.
Figure 4:
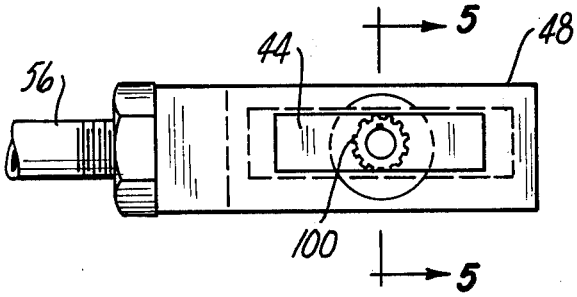
FIG. 4 is a side elevational view of the pattern carrier assembly shown in FIG. 3.
Figure 5:
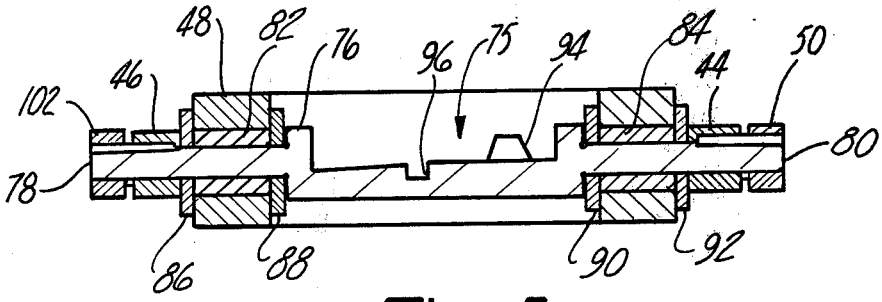
FIG. 5 is a view of a section taken along the line 5–5 shown in FIG. 4.

A pair of guide blocks 44 and 46 (FIG. 3) are adapted to slide between the various sets of guide bars during reciprocation of the pattern carrier assembly 10. Guidance also may be provided by engagement of the outer surfaces of yoke member 48 included in the pattern carrier assembly 10 engaging the vertical edges of the guide bars. Support for the pattern carrier assembly 10 intermediate the guide bars sets is provided by a pair of stationary racks 50 and 52, with the rack 50 and 52 (FIG. 3) secured as by welding to the lower guide bars 20 and 28 and 26 and 31 respectively.

The reciprocating force applied to the pattern carrier assembly 10 is contemplated as being provided by a hydraulic cylinder 54 having an actuator rod 56 secured to the rear of the yoke member 48. The hydraulic cylinder 54 is mounted to the rear of a cross bar 58 spanning the rear of the guide bars sets 20 and 22 and 24 and 26 respectively.

The mix dispensing station 12 includes a hopper 60 located thereat and having a rotary metering cylinder 62 disposed therein with funnel plates 64, 66 adapted to direct molding mix received from a loading chute 68 having a section 70 extending into bin 38 and having means at its lower terminus to remove mix from the bin 38 and charge the hopper 60. Since numerous devices for transferring mix in this manner are commercially available and well known, no details thereof are here included.

Figure 2:
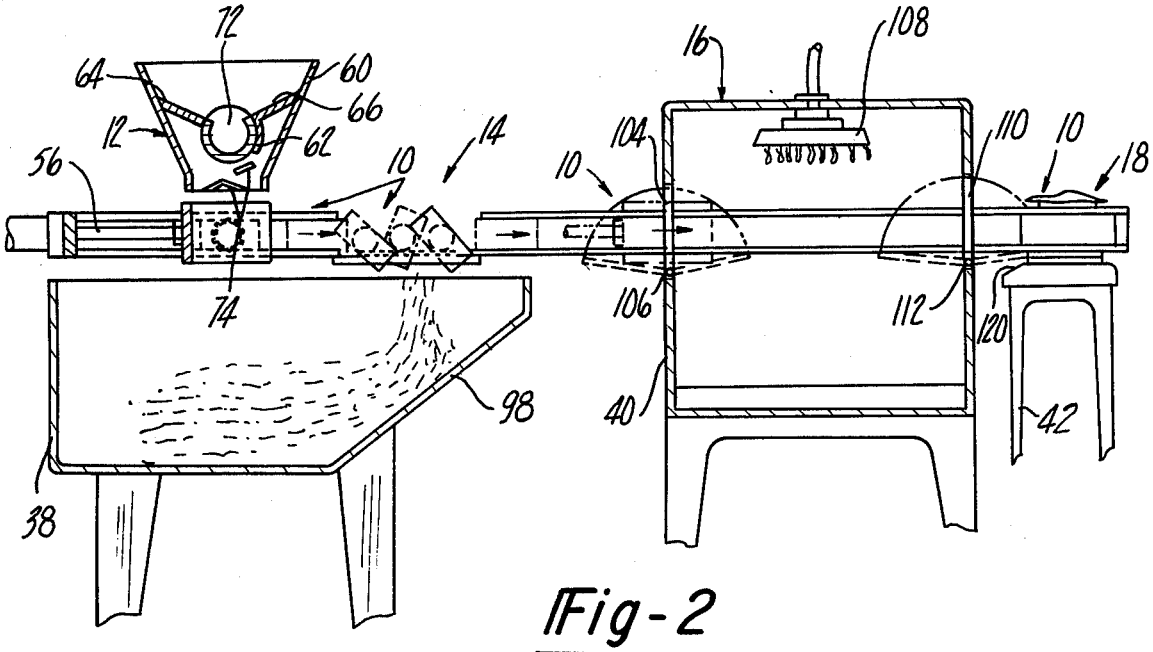
FIG. 2 is a sectional view of the apparatus according to the present invention partially shown in FIG. 1.

In order to dispense the quantity of mix contained in the metering cylinder 62 onto the pattern, the metering cylinder 62 is adapted to be rotated about its axis by means such as an electric motor 63 so that the slot 72 is inverted from the position shown in FIGS. 1 and 2. This allows discharge of the quantity of sand-resin mix contained within the metering cylinder 62. Deflector bars 74 are placed beneath the metering cylinder 62 so as to properly distribute the sand-resin mix charge over the heated pattern disposed thereunder on the pattern carrier assembly 10.

The mold pattern 75 is formed on a carrier plate 76 rotatably mounted in the yoke 48 by means of pins 78 and 80 disposed in bushings 82 and 84 and retained therein by means of thrust washers 86, 88, 90, 92. The mold pattern 75 typically includes surface contours such as the boss 94 and the groove 96 which would be complementary to the surface contours of the mold cavity.

Upon exiting from the mix dispensing station 12, the pattern carrier assembly 10 is advanced into the mix discharging station 14 at which point carrier plate 76 is adapted to be rotated to an inverted position so as to discharge the excess sand-resin mix back into the bin 38. This excess mix is collected thereinto by means of a protrusion 98 formed on the bin 38 in a position to collect the discharged sand-resin mix. This inversion is produced by means of a pair of rotary drive members comprised of pinion gears 100 and 102 affixed to the pins 78 and 80 and disposed to come into driving engagement with the respective stationary racks 50 and 52 so that as the yoke member 48 is advanced the driving engagement therebetween produces rotation of the carrier plate 76 to thereby produce the inversion. In order to provide clearance for the guide blocks 44 and 46 as the pinion shafts 78 and 80 rotate, the upper guide bar 22 and the upper guide bar 24 are shortened with respect to lower guide bars 20 and 26. The racks 50 and 52 each have a number of teeth slightly fewer than the number of teeth on the respective pinions 100 and 102 so that as the carrier assembly 10 advances to a position past the teeth, the guide blocks 44 and 46 have not quite been rotated to the horizontal position. This provides clearance for the pinion teeth to freely move away without any resultant rotation of the guide blocks 44 and 46. This eliminates any tendency of the guide blocks 44 and 46 to tend to be rotated into the lower guide bars 28 and 31 so as to cause a jammed condition. The final rotation of guide blocks 44 and 46 into parallelism with the guide bars 28 and 31 would be by virtue of the camming interaction therebetween. Upper guide bars 32 and 30 are shortened in similar fashion to the upper guide bars 22 and 24 so as to provide overhead clearance as the guide blocks 44 and 46 rotate into the horizontal position.

The carrier assembly would be advanced to the mold curing and pattern heating oven 16 where the leading edge of the yoke member 48 engages an entrance closure 104 which is hinged at 106 at its bottom and spring or counterweight biased to the vertical or closed position. Upon engagement with the yoke member 48 the entrance closure door moves inwardly as depicted in phantom in FIG. 2 to allow entrance of the pattern carrier assembly 10 into the mold curing and pattern heating oven 16. After entrance the biasing means returns the closure 104 to the vertical position with a slot 105 aligned with the operating rod 56 adapted so as to provide clearance therefor.

The mold curing and pattern heating oven 16 is adapted to be heated as by a gas burner assembly 108 to the proper shell mold curing temperature. After sufficient dwell time to complete the cure of the shell mold, the pattern carrier assembly 10 is further advanced by the hydraulic cylinder 54 to a mold unload station 18, exiting the shell mold curing and pattern heating oven 16 by virtue of the yoke member 48 engaging an exit closure 110 which is hinged at 112 at its bottom edge in similar fashion to the entrance closure 104. This closure is also biased by a spring or counterweight means to the vertical or closed position and adapted to open upon engagement thereof with the yoke member 48 so as to allow passage therethrough of the pattern carrier assembly 10 to the unloading station 18. Exit closure 110 is also slotted in similar fashion to entrance closure 104.

Upon unloading of the completed shell mold, the hydraulic cylinder 54 is operated to retract the pattern carrier assembly 10 into position within the oven housing 40, with the exit closure 110 moving inwardly upon engagement with the rear surface of the yoke member 48 as depicted in phantom in FIG. 2 to allow reentrance of the pattern carrier assembly 10 thereinto. The pattern carrier 10 is allowed to remain within the mold curing and pattern heating oven 16 until the mold pattern 75 has been heated to the proper temperature such that upon repositioning under the mix dispensing station 12, the mold pattern 75 will be at the proper temperature for creating adhesion to the sand-resin mix to the pattern disposed under the hopper 60. After such suitable delay the pattern carrier assembly 10 is then withdrawn from the curing oven 16 with the trailing edge of the yoke member 48 engaging the entrance closure 104 causing it to swing outwardly to allow movement of the carrier assembly 10 from the mold curing and pattern heating oven 16.

The carrier assembly 10 is then withdrawn to the initial position at the mold mix dispensing station 12 by virtue of further retraction of the operator rod 56 to be in position to initiate a new cycle.

The pattern carrier plate 76 may be modified in order to have replaceable multiple patterns affixed thereto as shown in FIGS. 6 and 7 which depict alternate constructions thereof. In FIG. 6 there is depicted a replaceable pattern body 112 which is adapted to be received within a space in the carrier plate 115 such that two patterns may be utilized simultaneously. Three or more patterns could also be provided in the same manner.

Pattern ejector pins may also be included as shown in FIG. 6 and includes a plurality of ejector pins 116 affixed to an ejector mounting plate 118 in connection therewith, a sloping cam surface 120 (FIG. 2) may be provided at the mold unload station 18 to cam the ejection mounting plate and connected ejector pins 116 upwardly to automatically free the shell mold from the pattern for manual or automated removal.

Another variation of the rack and pinion arrangement is also shown in FIG. 6 and would consist of the arrangement wherein a rack 122 and 124 are position in an overhead position with respect to the pinions 100 and 102 so as to eliminate the potential difficulties which would be created if mix were to fall onto the racks, causing clogging of the teeth thereof. In this case, support for the assembly would be provided by means of additional support rails 126 and 128 with a pair of grooved pulley wheels 130 and 132 supported on trunion pins 134 and 136 in engagement with the support rails 126 and 128, the complementary V-shaped configuration of the rails and pulley grooves also minimizing the possibility of collection of mix on the running surfaces thereof. This would also eliminate the use of the rockers as a weight bearing surface such that the traversing thereof across would be smooth.

It should also be understood that the control of the actuation of the hydraulic cylinder 54 would be carried out by conventional means such as limit switches cooperating with stops or cam surfaces, together with timers, relays, solenoid valves, etc., to provide proper stopping, starting, and dwelling of the pattern carrier assembly 10 as it is reciprocated through the various stations. In connection with this point, it will of course be appreciated that optimization of the relative velocity of advance and retraction could be incorporated in such control by these conventional means. This optimization for example could be in providing a relatively rapid advance through the discharge station 14, with a subsequent slow approach to the oven entrance closure 104. Since such control design features are contemplated as being conventional, no details hereof are here included.

It can thus be appreciated that the objects of the present invention have been accomplished by this arrangement inasmuch as only a single hydraulic cylinder is involved and a single oven both for pattern heating and mold curing with extremely simple transport means which could be extremely reliable and maintenance free. Heat waste is kept at a minimum by virtue of the single oven approach and the provision of closures which are in place at all times except when the pattern carrier 10 is actually entering or exiting the interior of the shell mold curing and pattern heating oven 16.

While the apparatus disclosed has particular application to shell molds, it can of course be appreciated that other molded shapes could be formed by this same apparatus.

I claim:

1. Apparatus for forming molded shapes such as shell molds including:

a pattern;

a pattern carrier assembly including means for supporting said pattern;

a molding mix dispensing station including means for dispensing a quantity of molding mix;

a heat oven;

a discharge station intermediate said dispensing station and said heating oven and also including means for inverting said pattern at said discharge station to discharge excess molding mix from said pattern, said means inverting said pattern including means rotatably mounting said pattern relative to said pattern carrier assembly;

transport means including means for advancing said pattern carrier assembly from an initial position at said mix dispensing station so that said pattern receives said quantity of molding mix dispensed at said dispensing station, through a position at said discharge station, said transport means including (A) means rotating said pattern therein by said transport means advancing said carrier assembly from said initial position through said discharge station to a position within said heating oven to cure said mold, and advanced thence to a position beyond said heating oven for mold unloading, said transport means also including means for subsequently retracting said pattern carrier assembly into said heating oven to preheat said pattern, and retracting said pattern carrier assembly to the initial position after said preheating of said pattern.

2. The apparatus according to claim 1 wherein said transport means comprises means for linearly reciprocating said pattern carrier assembly to carry out said advance and retraction thereof.

3. The apparatus according to claim 1 wherein said means rotating said pattern includes at least one stationary member and at least one rotary drive member moved in driving engagement with said stationary member by said transport means, said at least one rotary drive member being fixed relative to said pattern whereby said advance of said pattern carrier assembly rotates said pattern.

4. The apparatus according to claim 5 wherein said at least one stationary member comprises a rack and said at leat one rotary drive member is a pinion.

5. The apparatus according to claim 3 wherein said transport means includes means for reciprocating said yoke member and further includes guide track sections and also includes guide block members carried by said pattern carrier assembly and slidably engaging said guide track sections during said advancing and retraction movement.

6. The apparatus according to claim 5 wherein at least one of said guide block members is drivingly fixed to said at least one rotary drive member.

7. The apparatus according to claim 6 wherein said guide track sections are open at said discharge station whereby said guide blocks may rotate without interference therewith.

8. The apparatus according to claim 1 wherein said pattern carrier assembly includes a yoke member and further includes a pattern plate to which said pattern is fixed and wherein said means rotatably mounting said shell mold pattern includes means rotatably mounting said pattern plate on said yoke member by means of a pair of trunnion pins and wherein said means rotating said pattern includes a pair of rotary drive members affixed to a respective one of said trunnion pins and a pair of stationary members adapted to be engaged by a respective one of said rotary drive members as said pattern carrier assembly is advanced through said discharge station to thereby rotate said pattern plate.

9. The apparatus according to claim 8 wherein said rotary drive members are pinion gears and said stationary members are rack sections.

10. An arrangement for forming shell molds which includes:

a shell mold pattern;

a pattern carrier assembly including means for supporting said shell mold pattern therein;

a molding mix dispensing station including means for dispensing a quantity of molding mix;

a heating oven; and transport means for moving the pattern and carrier assembly between the dispensing station and the heating oven, the improvement comprising:

means for inverting the shell mold pattern to discharge excess mix dispensed at said mix dispensing station onto said pattern, said inverting means comprising:

means rotatably mounting said shell mold pattern relative to said pattern carrier assembly and further includes at least one stationary member and at least one rotary drive member drivingly engaging said stationary member and affixed relative to said shell mold pattern whereby said advance of said pattern carrier assembly by said transport means rotates said shell mold pattern.

11. The apparatus of claim 10 wherein said at least one stationary drive member comprises a rack and said at least one rotary drive member is a pinion.

12. The apparatus according to claim 10 wherein said pattern carrier assembly includes a yoke member and further includes a pattern plate to which said shell mold pattern is fixed and wherein said means rotatably mounting said shell mold pattern includes means rotatably mounting said pattern plate on said yoke member by means of a pair of trunnion pins wherein said means rotating said shell mold pattern includes a pair of rotary drive members affixed to a respective trunnion pin and a pair of stationary members adapted to be engaged by a respective one of said rotary drive members as said pattern carrier assembly is advanced through said discharge station to thereby rotate said pattern plates.

13. The apparatus according to claim 12 wherein said rotary drive members are pinion gears and said stationary members are rack sections.

14. The apparatus according to claim 13 wherein said racks are located above said pinions.

15. The apparatus according to claim 13 wherein said transport means includes means for reciprocating said yoke member and further includes guide track sections and also includes guide block members carried by pattern carrier assembly are slidably engaging said guide track sections during said advancing movement between said stations.

16. The apparatus according to claim 15 wherein at least one of said guide block members is drivingly affixed to said at least one rotary drive member.

17. The apparatus according to claim 16 wherein said guide track sections are open and said discharge station whereby said guide blocks may rotate without interference therewith.

18. The apparatus according to claim 13 wherein said transport means further includes a pair of wheels carried one each carried on each of said trunnion pins and also includes a rail engaged with each of said pair of wheels said rails supporting said pattern carrier assembly as said pattern carrier assembly is transported by said transport means.

19. The apparatus according to claim 18 wherein said pair of wheels are grooved, and wherein said rails are complementarily shaped on an upper surface thereof.

20. The apparatus according to claim 18 wherein said racks are located above said pinions.

21. An apparatus for forming shell molds including a shell mold pattern, pattern carrier assembly, including means for supporting said shell mold pattern therein, a mold mix dispensing station including means for dispensing a quantity of molding mix and a heating oven, the improvement comprising:

transport means for advancing and retracting said pattern carrier assembly from an initial position at said dispensing station to said oven and back to said dispensing station, said transport means including an operator rod affixed to said pattern carrier assembly and also includes means for reciprocating said operator rod, the improvement further comprising:

a movable closure included in said heating oven, said movable closure being biased in a closed position and engageable by said pattern carrier assembly upon advancing movement thereinto to be moved to allow said pattern carrier assembly to enter said heating oven, said movable closure including a slot formed thereon aligned with the position of said operating rod whereby said closure may return to the closed position with said operator rod extending into said heating oven.

* * * * *

UNITED STATES PATENT OFFICE
CERTIFICATE OF CORRECTION

Patent No. 4,059,144 Dated November 22, 1977

Inventor(s) Delbert Eugene Esche

It is certified that error appears in the above-identified patent and that said Letters Patent are hereby corrected as shown below:

Column 6, line 22 "carrier 10" should be --carrier assembly 10--.

Column 7, line 7 "leat" should be --least--; line 8 "Claim 3" should be --Claim 1--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*